US005974293A

United States Patent [19]

Fromm

[11] Patent Number: 5,974,293

[45] Date of Patent: Oct. 26, 1999

[54] DONOR BRUSH WITH OIL BARRIER LAYER

[75] Inventor: Paul M. Fromm, Rochester, N.Y.

[73] Assignee: Xerox Corporation, Stamford, Conn.

[21] Appl. No.: 08/356,618

[22] Filed: Dec. 15, 1994

[51] Int. Cl.[6] ..... G03G 15/20

[52] U.S. Cl. ..... 399/325; 118/60

[58] Field of Search ..... 355/284; 118/60; 219/216; 492/17, 18, 51, 54–56; 399/324, 325

[56] References Cited

U.S. PATENT DOCUMENTS

| | | | |
|---|---|---|---|
| 4,214,549 | 7/1980 | Moser | 118/60 |
| 4,426,953 | 1/1984 | Kromm, Jr. et al. | 118/60 |
| 4,579,802 | 4/1986 | Kishi et al. | 355/284 X |
| 5,145,525 | 9/1992 | Fromm et al. | 118/60 X |
| 5,200,786 | 4/1993 | Fromm et al. | 355/284 |
| 5,232,499 | 8/1993 | Kato et al. | 355/284 |
| 5,235,394 | 8/1993 | Mills, III et al. | 355/284 |
| 5,267,004 | 11/1993 | Mills | 355/284 |
| 5,356,473 | 10/1994 | Fromm | 118/60 |

*Primary Examiner*—Robert Beatty

[57] ABSTRACT

A release agent (i.e. silicone oil) management system including a metering roll supported for contact with release agent material contained in a sump. The metering roll contacts a donor brush which, in turn, contacts one of a pair of fuser roll member. The donor brush comprises a rigid core having a non-woven felt layer adhered to the core. The felt layer provides a soft, nip forming layer. The felt layer is covered with a woven tube of Nomex to reduce the loss of loose fibers from the Nomex material. An oil barrier layer is provided between the Nomex tube and the felt layer for preventing or minimizing oil penetration into the oil permeable nip forming felt layer.

7 Claims, 3 Drawing Sheets

DONOR BRUSH WITH OIL BARRIER LAYER

BACKGROUND OF THE INVENTION

The present invention relates to fuser apparatus for electrostatographic printing machines and in particular to release agent management (RAM) systems for a heat and pressure roll fuser.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

Various systems have been used to deliver release agent fluid to the fuser roll including the use of oil soaked rolls and wicks with and without supply sumps as well as oil impregnated webs. A another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

Xerox Disclosure Journal (XDJ) Volume 7, Number 3 dated May/June 1982 discloses a release agent management system for a roll fuser apparatus. The apparatus comprises a fuser roll to which silicone oil is applied in order to counteract toner offset to the fuser roll. The fuser roll cooperates with a softer pressure roll to fuse toner images to a copy substrate such as plain paper. The silicone oil which is contained in a sump is applied to the surface of the fuser roll by means of a rotating brush which is adapted to be rotated in the opposite direction to that of the fuser roll. The brush engages one end of a wick while the other end of the wick is immersed in the silicone oil. Thus, the brush picks up silicone oil from the wick and conveys it to the fuser roll surface. Since the brush rotates counter to the fuser roll the brush bristles strip the lead edge of the copy and deflect it down and away from the fuser roll. The brush fibers undergo a snapping or flicking action as they move out of the nip formed between them and the fuser roll. It is this action which yields the stripping action. The oil application rate is controlled by the brush fiber density and the velocity of the fuser roll.

In U.S. Pat. No. 5,200,786 granted to Fromm et al on Apr. 6, 1993, the donor roll of the '549 patent is replaced with a donor brush. As set forth in the '786 patent, the brush donor structure allows for the application of variable amounts of release agent material depending on the mode of operation. In other words, when color prints are being created a greater quantity of silicone oil is applied to the fuser roll compared to the amount applied when operating in the monochrome black mode.

In a donor brush RAM system of the type disclosed in the '786 patent, both fuser rolls (heated and backup) and the donor brush will reach an equilibrium with the oil on the metering roll when the oil is not removed from the fuser. The oil film thickness on the metering roll is much greater than the normal steady state oil film thickness on the brush and fuser rolls. If a machine were required to handle a single size substrate and the donor brush only applied oil to the fuser rolls in areas corresponding to that contacted by the single substrate the aforementioned equilibrium would not occur because the paper would continuously remove oil from the fuser roll. This would reduce the problem of excess release oil outside the paper path to only the narrow zone between the brush edge and paper path edge resulting from paper registration tolerance and subsystem tolerances. Excessive oil outside the paper path occurs when narrower width copy paper is used, particularly, when used for extended copy runs. However, other solutions for preventing excess oil accumulation outside the paper path have not been successful in solving the problem of excess oil occurring between copy sheets and during dead cycles.

Excess oil accumulation outside the paper path is a serious problem, particularly when long copy runs are made. Such oil accumulation must be prevented or at least minimized, otherwise oil will drip into the machine and/or cause copy quality defects from oil spots and/or steaks when switching to wider paper and/or cause deterioration of the fuser roll material when the outer surface of the fuser roll comprises silicone rubber. When roll deterioration occurs, a product of such deterioration is transferred to the wider paper. This results in the phenomena commonly referred to as red printout.

BRIEF SUMMARY OF THE INVENTION

Briefly, the present invention comprises a RAM system including a metering roll supported for contact with release agent material contained in a sump. The metering roll contacts a donor brush which, in turn, contacts one of a pair of fuser roll member.

The donor brush comprises a rigid core on which a woven felt layer is adhered. The felt layer provides a soft, nip forming layer. In prior art donor rolls of the type contemplated herein, the felt layer is covered with a woven tube of Nomex. The purpose of the Nomex tube is reduce the loss of loose fibers from the Nomex material. Other woven constructions, similar to that used for paint rollers, have better inherent fiber retention capabilities but suffer from poor dimensional (i.e. diameter) stability.

Felt materials of the type used in prior devices soak up large amounts of release oil which aggravates the problems associated with the presence of excess oil by increasing the total amount of accumulated oil and thus increasing the time needed to get rid of it.

According to the present invention, means are provided for minimizing the problem of oil accumulation. To this end a donor brush structure of the type discussed above is provided with an oil barrier layer between the Nomex tube and the felt layer. The oil barrier material comprises a relative oil impervious material such as polyimide or polytetraflouroethylene. The barrier serves to prevent excess oil from being absorbed by the felt layer of the donor brush from the metering roll while still allowing slight lateral spreading of the oil. Slight lateral spreading allows larger mis-registration between the donor brush or gross oil width controller and the paper path.

DESCRIPTION OF THE PREFERRED EMBODIMENT

Figure 3:
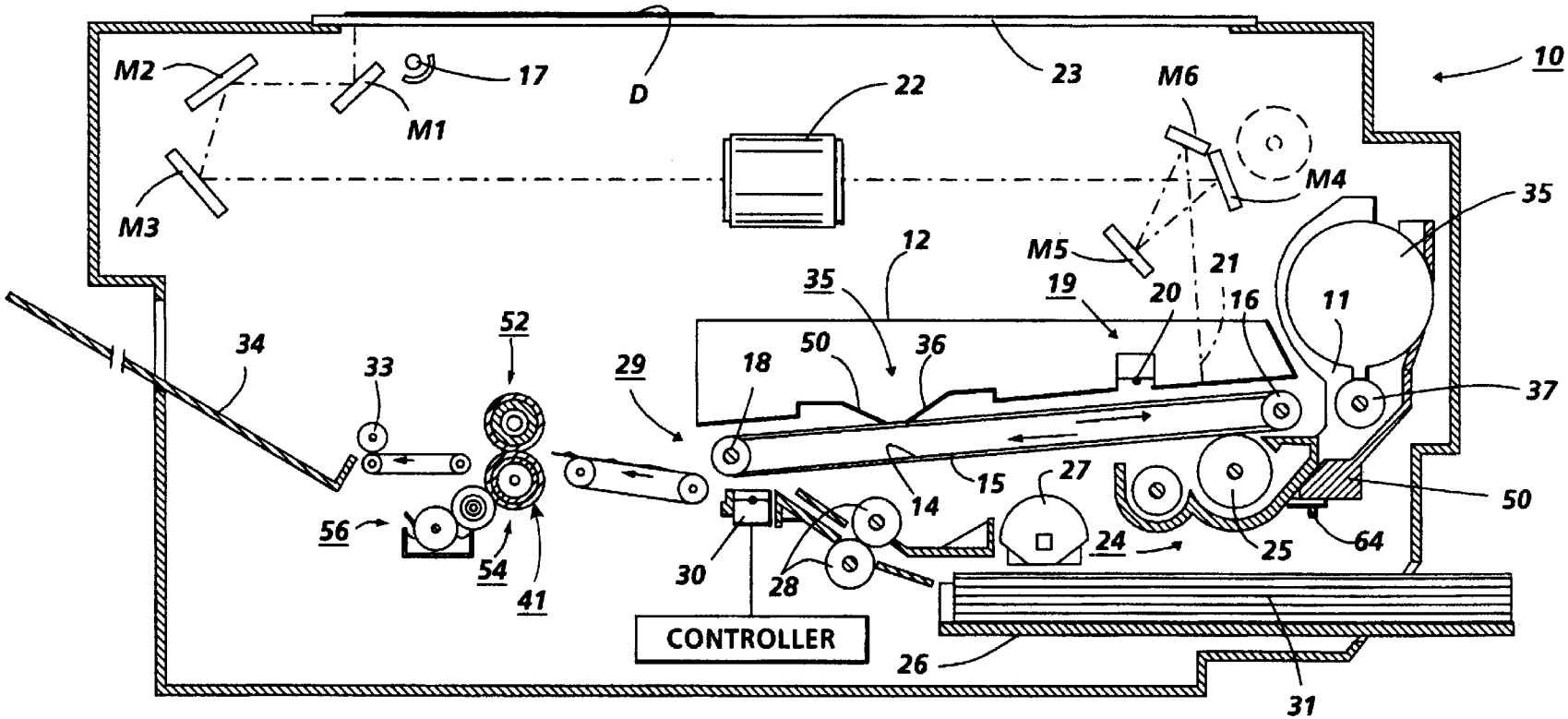
FIG. 3 is a schematic illustration of a copying machine incorporating the invention.

Referring now to FIG. 3, there is shown by way of example, an automatic electrostatographic reproducing machine 10 which includes a removable processing cartridge 12. The reproducing machine depicted in FIG. 3 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 3 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fixing station 41 comprising heated fuser roll 52 and pressure roll 54 forming a nip therebetween wherein roll fuser 52 fixes the transferred powder image thereto.

Invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scrapping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 1:
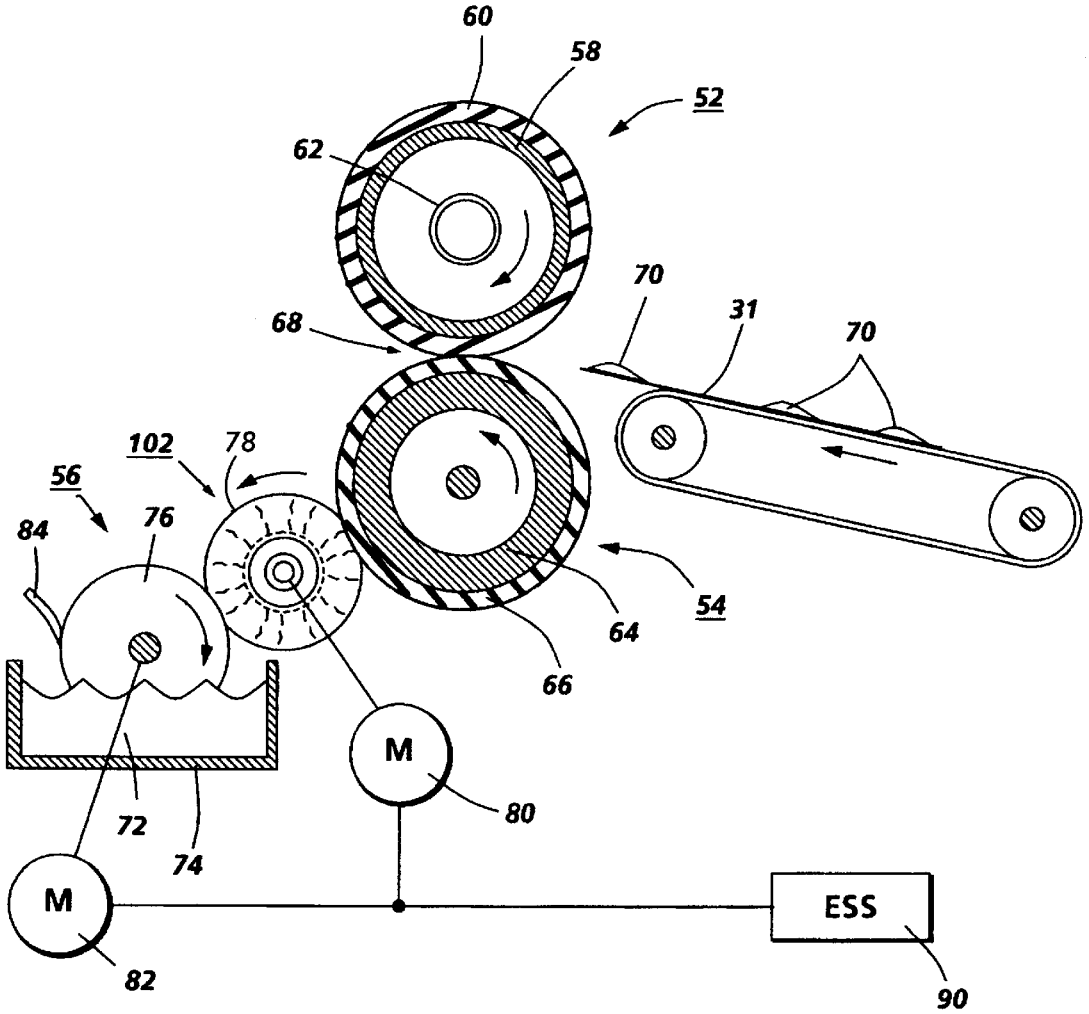
FIG. 1 is a schematic representation of a roll fuser and a release agent management (RAM) system representing one embodiment of the invention.

Attention is now directed to FIG. 1 wherein the heat and pressure fuser apparatus comprising the fuser roll 52 and pressure roll 54 are illustrated together with a release agent management (RAM) system 56. As shown in FIG. 1, the fuser apparatus comprises the heated fuser roll 52 which is composed of a core 58 having coated thereon a thin layer 60 of an elastomer or other low surface energy materials such as Teflon™. The core 58 may be made of various metals such as iron, aluminum, nickel, stainless steel, etc., and various synthetic resins. Aluminum is preferred as the material for the core 58, although this is not critical. The core 58 is hollow and a heating element 62 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials such as the RTV and HTV silicone elastomers such as a copolymer of vinylidene and hexafluoropropylene commonly known as Viton (trademark of E.I. du Pont de Nemours & Co.) or Teflon™ type materials.

The fuser roll 52 is shown in a pressure contact arrangement with the backup or pressure roll 54. The pressure roll 54 comprises a metal core 64 with a layer 66 of a heat-resistant material compliant material. In this assembly, both the fuser roll 52 and the pressure roll 54 are mounted on bearings (not shown) which are biased so that the fuser roll 52 and pressure roll 54 are pressed against each other under sufficient pressure to form a nip 68. It is in this nip that the fusing or fixing action takes place. The layer 66 may be made of any of the well known materials such as fluorinated ethylene propylene copolymer or silicone rubber.

The image receiving member or final support 31 having toner images 70 thereon is moved through the nip 68 with the toner images contacting the heated fuser roll 52. The toner material forming the image 70 is prevented from offsetting to the surface of the fuser roll 52 by the application of a release agent material such as silicone oil 72 contained in sump 74.

The sump 74 and silicone oil 72 form part of the RAM system 56. The RAM system 56, according to one embodiment of the invention, further comprises a metering roll 76 and a donor brush 78. The metering roll is supported partially immersed in the silicone oil 72 and contacts the donor brush for conveying silicone oil from the sump to the bristles of the donor brush 78. The donor brush is rotatably supported in contact with the metering roll and also in contact with the pressure roll 54. While the donor brush is illustrated as contacting the pressure roll, it will be appreciated that, alternately, it may contact the fuser roll 52. Also, the positions of the fuser and pressure rolls may be reversed for use in other copiers or printers. A metering blade 84 supported in contact with the metering roll 76 serves to meter silicone oil to the required thickness on the metering roll.

Whereas the contact of the donor roll of the '549 patent with its associated metering roll and the roll to which it delivers silicone oil is intimate (i. e. a high percentage of contact) the contact of the donor brush 78 with the pressure roll 54 and the metering roll 76 is only about 10%. The low percentage of contact between the donor brush and the other rollers provides for low torque transmission from the donor brush to the metering and fuser rolls. In operation, the donor brush tends to slide relative to the metering and pressure rolls and the area of contact therebetween is very low, approximately 10%.

The donor brush 78 may be operatively connected to the pressure roll to be driven thereby or it may be driven independently via a drive motor 80. The metering roll is operatively connected to a motor 82 for driving it independently of the fuser roll and donor brush. The metering roll is a smooth-surfaced metal roll on which the oil picked up from the sump is metered to the desired thickness by a metering blade 84. The metering roll is adapted to be driven at different speeds to deliver different oil quantities of oil. To this end the motor 82 is suitable for rotating the metering roll in the order of 5 to 100 RPM which is about 1 to 20% of the rotational speed of the pressure roll 54. The metering roll has a diameter of 20–75 mm and the donor brush has a diameter in the order of 20–40 mm.

The donor brush 78 is fabricated by weaving heat-resistant fibers into the desired structure which fibers comprise, by way of example, a copolymer of meta-phenylenediamine and isophthaloyl chloride. A loading pressure of 0.5 to 10 PSI causes the donor brush to conform to the surfaces of the pressure and metering rolls. At the forgoing speeds, the brush fibers serve to deliver in the order of 1 to 6 $\mu$l of silicone oil.

The speed of the metering roll is controlled by the motor 82 which is, in turn, controlled by the Electronic Subsystem (ESS) 90. The ESS comprises the necessary electronics and logic circuitry, well know in the art, to process control signals generated by a sensor, not shown. The speed of the metering roll causes the metering roll to deliver somewhere between 1 to 6 $\mu$l of silicone oil to the donor brush in accordance with an algorithm forming a part of the ESS.

Figure 2:
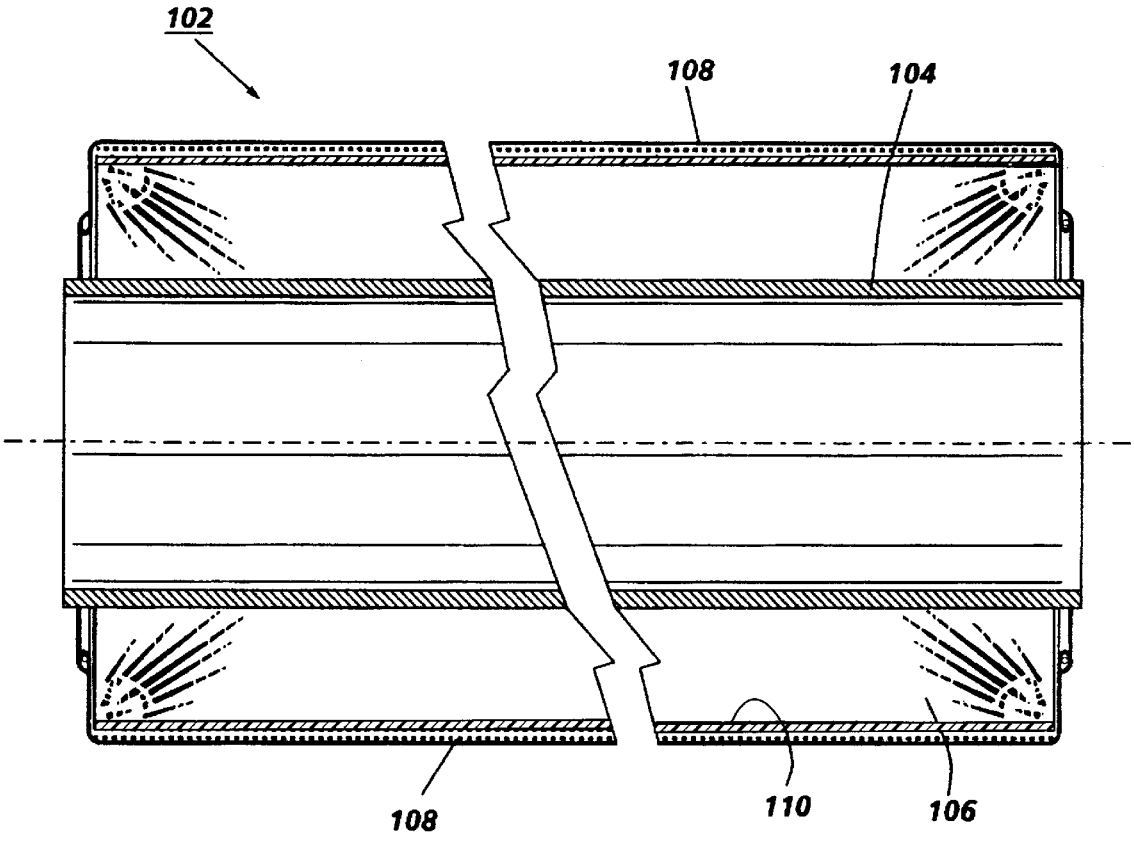
FIG. 2 is an enlarged view of a donor roll according to the invention.

As disclosed in FIG. 2, a donor structure 102 according to the present invention comprises a rigid core 104 having adhered thereto a porous felt or wick layer 106 of the type commonly used in the xerographic fusing arts. Such a material contains loose fuzz resulting from the fabrication process of the felt. A Nomex tube or sleeve 108 prevents loss of fibers and, therefore, contamination of other areas. The sleeve is preferably woven from a heat-resistant material such as the copolymer of metaphenylenediamine and isophthaloyl chloride.

An oil impermeable layer or film member 110 is provided between the felt layer 106 and the sleeve 108. The layer 110 is preferably fabricated from a polyimide or polytetraflouroethylene. This layer serves as an oil barrier layer between the sleeve of Nomex and the felt layer. It is effective to prevent the felt layer from soaking up excessive amounts of oil as in the case with prior devices. The barrier layer 110 is also effective in minimizing excessive lateral spread of release oil beyond the paper path but not completely eliminating it so oil can be spread to the edges of the paper if the oiled width of the fuser is too narrow. Viton or silicone rubber may be utilized in lieu of the felt layer 106.

Adherence of the barrier film to the felt layer 106 may be effected using an adhesive which remains flexible when cured. The surface of the barrier film contacting the tube or sleeve 108 may be roughened to provide sufficient friction therebetween so that bonding of these two members is not required. When an adhesive is employed for adhering the tube to the felt layer care must be taken not to contaminate the voids in the tube with the adhesive material.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. Apparatus for applying offset preventing liquid to one member of a contact fuser for fixing powder images to a substrate, said apparatus comprising:

a supply of release agent material;

a release agent metering member supported for contact with said supply of release agent material;

means for effecting movement of said metering member in an endless path at different surface velocities;

donor brush supported in contact with said metering member and a fuser member of said contact fuser for conveying release agent material from the former to the latter, said donor brush structure comprising a rigid core, a nip forming layer adhered to said core and sleeve covering said nip forming layer; and a release agent barrier layer disposed intermediate said sleeve and said nip forming layer for minimizing amount of release agent absorbed by said nip forming layer.

2. Apparatus according to claim 1 wherein said barrier layer comprises a polyimide material.

3. Apparatus according to claim 1 wherein said barrier layer comprises polytetraflouroethylene.

4. A donor structure according to claim 1 wherein said nip forming layer comprises felt.

5. A donor structure according to claim 1 wherein said nip forming layer is fabricated from silicone rubber.

6. A donor structure according to claim 1 wherein said nip forming layer comprises a copolymer of vinylidene and hexafluoropropylene.

7. A donor structure for use in a release agent management system, said donor structure comprising:

a rigid core;

a nip forming layer adhered to said core;

an oil permeable sleeve over said layer; and a release agent barrier layer comprising a polymer selected from the group consisting of polyamide or polytetrafluoroethylene and disposed intermediate said sleeve and said nip forming layer for minimizing permeation of release agent material into said nip forming layer.

* * * * *